US006408472B1

(12) United States Patent
Huang

(10) Patent No.: US 6,408,472 B1
(45) Date of Patent: Jun. 25, 2002

(54) FIXING TOOL FOR HOLDING A MIDSOLE AND A SHOETREE

(76) Inventor: Hsi-Mou Huang, No. 5, Section 2, Lane 117, Fu-Tan Road, Ping-Chen City, Tao-Yuan Hsien (TW)

( * ) Notice: Subject to any disclaimer, the term of this patent is extended or adjusted under 35 U.S.C. 154(b) by 0 days.

(21) Appl. No.: 09/839,628

(22) Filed: Apr. 20, 2001

(51) Int. Cl.[7] ..... A43D 15/00
(52) U.S. Cl. ..... 12/103; 12/128 D; 12/128 F
(58) Field of Search ..... 12/103, 128 C, 12/128 D, 128 F, 128 R

(56) References Cited

U.S. PATENT DOCUMENTS 2,068,694 A * 1/1937 Parker ..... 12/103
3,006,007 A * 10/1961 Kotyk ..... 12/128 F
3,744,074 A * 7/1973 Stapleton ..... 12/128 D
3,935,609 A * 2/1976 Brotchie ..... 12/128 D

* cited by examiner

*Primary Examiner*—M D Patterson
(74) *Attorney, Agent, or Firm*—Steven J. Hultquist; Marianne Fuierer; Yongzhi Yang

(57) ABSTRACT

A fixing tool for temporarily holding a midsole and a shoetree in shoe industry includes a screw base and a screw body. The screw base is formed as a hollow hob screw with both an inner thread and an outer thread. The screw body further includes a screw holder and a screw. The screw has a flat round top portion with periphery notches and is pivoted at a center thereof to allow the top portion able to make a 90° rotation. The screw base is used to be screwed into a proper position at the bottom of the shoetree. The screw of the screw body is then engaged with the respective screw base through the midsole for temporarily fixing the midsole and the shoetree. The screw holder of the screw body can be pushed aside to contact with the midsole. Unlike the conventional nail-fixing, the fixing tool of the present invention can hold the midsole and the shoetree by only screwing the screw of the screw body into the screw base. By providing the fixing tool of the present invention, the screw body can be re-used, the damage upon the shoetree can be avoided, the labor can be saved and the cost for manufacturing the shoe can be reduced.

1 Claim, 2 Drawing Sheets

FIXING TOOL FOR HOLDING A MIDSOLE AND A SHOETREE

BACKGROUND OF THE INVENTION (1) Field of the Invention

The invention relates to a fixing tool for holding a midsole and a shoetree in the shoe industry, and more particularly to a temporary fixing tool which can be re-used and can minimize the damage upon the shoetree.

(2) Description of the Prior Art

It is well known that shoes play important roles in people daily dressing, yet few know how the shoe is produced. In fact, even a pair of ordinary shoes need complicated manufacturing processes. In the shoe industry, a so-called wooden "shoetree" which mimics a foot profile is prepared before a shoe can be made. Then, a shoe can be made in accordance with the contour provided by the shoetree. Therefore, formation of the shoetree is so important that it requires to meet every foot's need and thereby to form a shoe with great wearing comfort.

Conventionally, a bottom structure of shoe includes at least three layers: an inner sole, a midsole and an outer sole. The inner sole is the upper layer which is generally placed at a final step of manufacturing the shoe. The outer sole is the lowest layer that contacts with the ground. The midsole is the middle layer sandwiched by the inner sole and the outer sole. In manufacturing the shoe, a midsole is firstly nail-fix to a bottom of the shoetree temporarily. Then, a vamp with coarse sewing is fixed to the midsole in accordance with the contour provided by the shoetree. No matter what fixing method (sewing or gluing) is applied to integrate the vamp and the midsole, a sufficient and necessary requirement is that the midsole needs to be stable in position under the shoetree. Generally in the art, nails are usually used to fix the midsole to the bottom of the shoetree. Nevertheless, the nailing method has some obvious disadvantages as follow.

1. After the midsole and the vamp are fixed, the shoetree needs to be removed so that following steps of manufacturing the shoe can be proceeded. That is to say that the nails for fixing the midsole to the shoetree need to be pulled off in advance. It is well known that pulling a nail is generally not an easy job, in particular for those nails that are firmly hammered into the wooden shoetree. At this time, using a nail puller to remove the nail is hard and quite possible will damage the midsole as well as the shoetree.
2. Not only the nail is hard to be removed, but also the pulled nail cannot be re-used which will form a kind of material waste.
3. Repeatedly using the nails at the same positions of the shoetree will definitely damage the shoetree gradually. Therefore, the lifetime of the shoetree is usually short. Yet, unit price for a shoetree is usually high so that substantial cost needs to be invented on replacing the shoetree while manufacturing the shoe.

SUMMARY OF THE INVENTION

Accordingly, it is a primary object of the present invention to provide a fixing tool for holding a midsole and a shoetree, which a threaded part is used to replace the conventional nail. The fixing tool of the present invention includes a screw base and a screw body. The screw base is a hollow hob screw with both an outer thread and an inner thread. The screw body is formed by a screw with a flat round head and a turnable screw holder.

While applying the fixing tool in fixing a midsole onto a bottom of a shoetree the screw base is firstly screwed into a proper position at the bottom of the shoetree. Then, the midsole can be placed smoothly onto the bottom of the shoetree. Finally, the screw body is used to penetrate the midsole and fastened to the screw base. After the screw holder is bent aside, the midsole can be temporarily fixed to the shoetree.

After a vamp is fixed to the midsole, the screw holder can be bent to its original upright position and is turned to screw off the screw thereof for relieving the midsole from the shoetree.

By providing the fixing tool of the present invention, the fixing process between the midsole and the shoetree become easily and no harm can be made to the shoetree. Also, the screw body can be always re-used so that the laboring and the cost for manufacturing the shoe can be reduced.

All these objects are achieved by the fixing tool for holding a midsole and a shoetree described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a fixing tool for a midsole and a shoetree. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
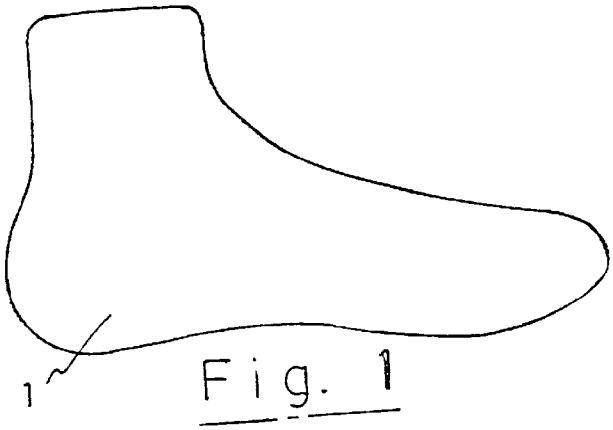
FIG. 1 is a schematic view of a conventional shoetree.

FIG. 1 is a schematic view of a conventional shoetree 1. For a manufacturing purpose the shoetree 1 is usually made of wood to make easy the temporary nailing of the midsole.

Figure 2:
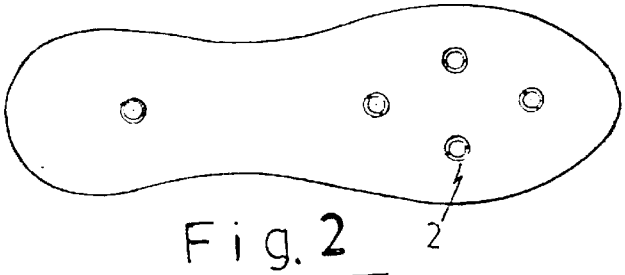
FIG. 2 is a bottom view of FIG. 1.

FIG. 2 is a bottom view of the shoetree 1. As shown, the bottom of the shoetree 1 includes a plurality of screw bases 2 at some proper positions thereof for locating respectively the fixing tool of the present invention. According to the present invention, the positions and the number for mounting the screw bases 2 are dependent upon the contour variation of the bottom of the shoetree 1. In the case that the contour variation is remarkable, like a high-heel shoe, the shoetree 1 needs more screw bases 2 to stabilize the fixing of the midsole onto the bottom of the shoetree 1.

Figure 3:
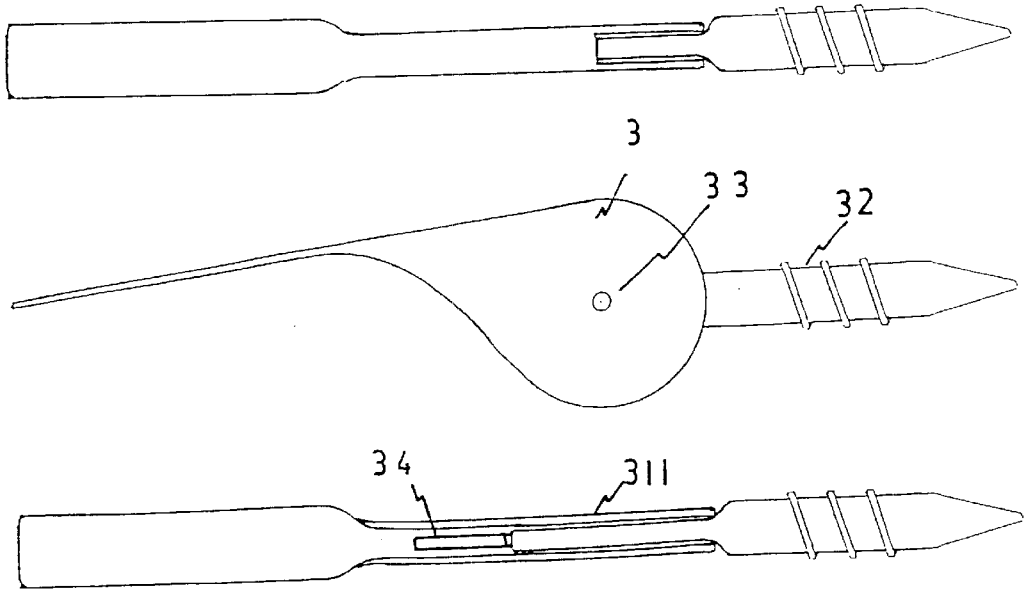
FIG. 3 shows three side views of a screw body for a preferred fixing tool in accordance with the present invention.
Figure 4:
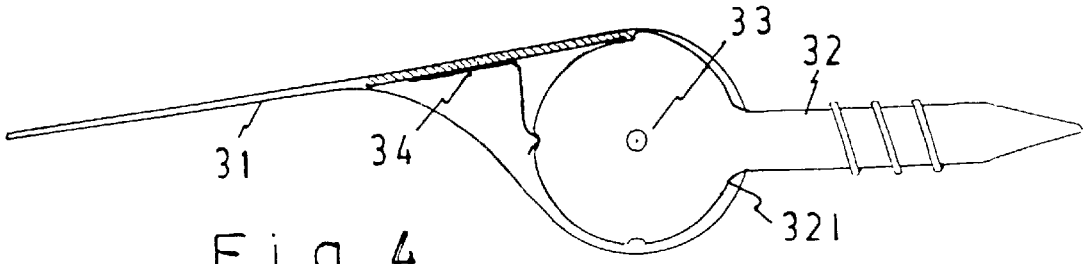
FIG. 4 is a partly cross-section view of the screw body of FIG. 3.

FIG. 3 and FIG. 4 show three side views and a partly cross-section view of a screw body 3 for a preferred fixing tool in accordance with the present invention, respectively. As shown, the screw body 3 further includes a screw holder 31 and a screw 32. The screw 32 has a top portion 321 formed as a flat round shape to be clamped in a clip 311 of the screw holder 31. A pivot 33 is also provided at a center of the top portion 321 to allow the top portion 321 to rotate around. The clip 311 of the screw holder 31 includes thereinside a leaf spring 34 for anchoring the screw 32 so as to allow the screw holder 31 staying at a more accessible upright position while not in usage.

Figure 5:
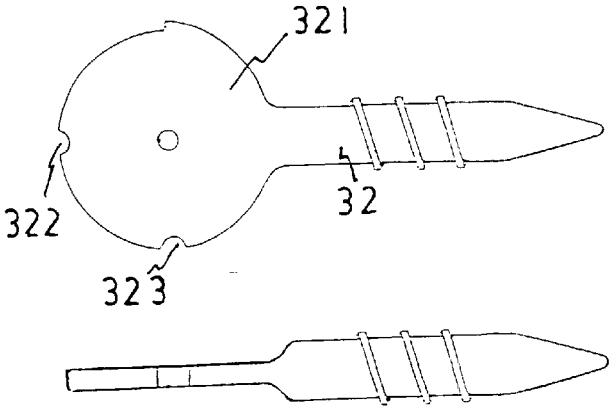
FIG. 5 shows two side views of a screw for the screw body of FIG. 3.

FIG. 5 shows two side views of the screw 32 of the screw body 3. The flat round top portion 321 of the screw 32 includes two periphery notches 322 and 323 for matching with the leaf spring 32 shown in FIG. 4. By providing the notches 322 and 323 and the leaf spring 34, the screw body 3 can persist a stable state at the upright position while not in usage and another stable state at a lower position with the screw holder 31 depressed to the midsole. While the screw holder 3 poses the lower stable state, next manufacturing process upon the midsole will not be interfered.

Figure 6:
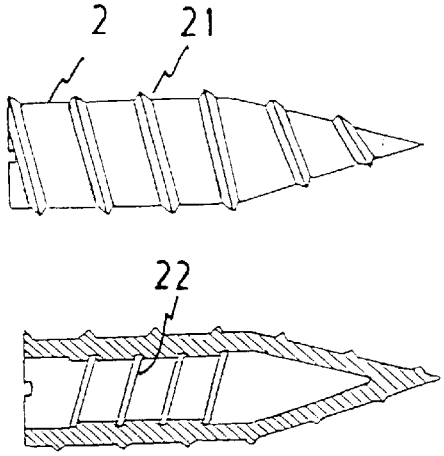
FIG. 6 shows a side view and a cross-section view of a screw base for a preferred fixing tool in accordance with the present invention.

FIG. 6 shows a side view and a cross-section view of the screw base 2 for the preferred fixing tool in accordance with the present invention. The screw base 2 is a hollow part including an inner thread 22 for matching with the screw 32 and an outer thread 21 to be screwed into a proper position at the bottom of the shoetree 1 as shown in FIG. 2. While the screw base 2 is positioned at the shoetree 1, the flat head of the screw base 2 is preferably flush with the bottom surface of the shoetree 1. In the present invention, the inner thread 22 of the screw base 2 can be arranged to have a minimum number of turns so that the working time for engaging with the screw 32 can be reduced. Once the screw base 2 is located to the shoetree 1, yet the screw base 2 is still removable from the shoetree 1 theoretically. However, in practice, the screw base 2 is seldom removed from the shoetree 1. Preferably, the screw bases 2 are fixed to the shoetree 1 right after the shoetree is produced. On the other hand, while tailoring the midsole 4, a plurality of holes are included at proper positions on the midsole 4 to account for the screw bases 2 on the shoetree 1. These holes can allow the screws 32 of the fixing tool to penetrate therethrough easily and so to allow the penetrating screws 32 to further engage with the respective screw bases 2 on the shoetree 1. After the screw 32 engages with the screw base 2, the screw holder 31 can be turned aside and thus the midsole 4 can be temporarily fixed to the bottom of the shoetree 1 as shown in FIG. 7.

In the present invention, the screw 32 can be tiny as a pin and will not damage substantially the midsole 4 after it is be pulled off. The only damage that the screw 32 can made is just a tiny hole as made by a traditional tiny nail. In addition, after placing at least a layer of the inner sole on top of the midsole 4, the possible wearing discomfort can be removed and the appearance of the midsole 4 with tiny holes can be covered.

Figure 7:
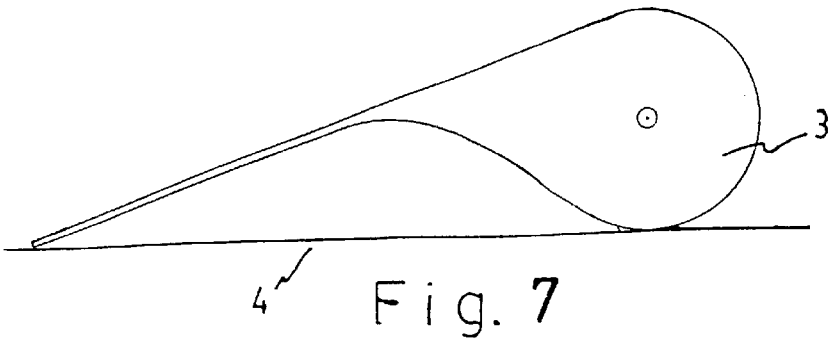
FIG. 7 is a side view showing the fixing tool of the present invention applied to a midsole.

FIG. 7 is a side view showing the fixing tool of the present invention applied to a midsole 4, in which the screw holder 31 is depressed aside to hold the midsole 4.

By providing the present invention, it is obvious that the operation of the fixing tool is quite convenient and the shoetree 1 can be prevented from the damage caused by repeatedly using the nails. Also, the cost-down benefit obtained by re-using the fixing tool of the present invention does contribute greatly to the shoe industry.

While the present invention has been particularly shown and described with reference to a preferred embodiment, it will be understood by those skilled in the art that various changes in form and detail may be without departing from the spirit and scope of the present invention.

I claim:

1. A fixing tool for holding a midsole and a shoetree, comprising a screw base and a screw body, the screw base formed as a hollow hob screw with both an inner thread and an outer thread, the screw body further including thereof a screw holder and a screw, the screw having a flat round top portion and periphery notches, and the top portion of the screw being clamped by the screw holder so as able to make a 90° rotation.

* * * * *